US009808074B2

(12) United States Patent
Kinskey

(10) Patent No.: US 9,808,074 B2
(45) Date of Patent: Nov. 7, 2017

(54) AIR GUN HOLSTER POUCH AND METHOD OF USING THE SAME

(71) Applicant: L.F. Centennial Ltd., Road Town, Tortola (VG)

(72) Inventor: Terrence P. Kinskey, Alpharetta, GA (US)

(73) Assignee: L.F. CENTENNIAL LTD., Tortola (VG)

( * ) Notice: Subject to any disclaimer, the term of this patent is extended or adjusted under 35 U.S.C. 154(b) by 0 days.

(21) Appl. No.: 14/628,407

(22) Filed: Feb. 23, 2015

(65) Prior Publication Data

US 2015/0238000 A1 Aug. 27, 2015

Related U.S. Application Data

(60) Provisional application No. 62/001,664, filed on May 22, 2014, provisional application No. 61/942,854, filed on Feb. 21, 2014.

(51) Int. Cl.
*A45F 5/02* (2006.01)

(52) U.S. Cl.
CPC ..... *A45F 5/021* (2013.01); *A45F 2200/0575* (2013.01)

(58) Field of Classification Search
CPC .. A45F 2200/0575; A45F 5/021; B25H 3/006
USPC ..... 224/904; D3/228
See application file for complete search history.

(56) References Cited

U.S. PATENT DOCUMENTS 954,765 A * 4/1910 Rune ..... A45F 5/02 224/907
1,326,887 A * 12/1919 Wood ..... A45F 5/02 2/300
3,157,927 A * 11/1964 Roden ..... A45F 5/02 206/259
D213,451 S * 3/1969 White ..... D3/228
D221,123 S * 7/1971 Nicholas ..... D3/228
3,599,847 A * 8/1971 Danielson ..... A45F 5/02 224/673
D240,370 S * 7/1976 Kuehl ..... D3/228
D242,409 S * 11/1976 Enckler ..... D6/566
D248,066 S * 6/1978 Hillinger ..... D3/228
4,106,679 A * 8/1978 Hillinger ..... A45F 5/00 224/197
D253,019 S * 10/1979 Hillinger ..... D3/228
D254,759 S 4/1980 Rodstein
D258,550 S * 3/1981 Strauss ..... 224/673
4,356,854 A 11/1982 McGee (Continued)

FOREIGN PATENT DOCUMENTS

CA 2755685 4/2013
CA 2800605 7/2014

*Primary Examiner* — Justin Larson
(74) *Attorney, Agent, or Firm* — Duane Morris LLP; J. Rodman Steele, Jr.; Gregory M. Lefkowitz

(57) ABSTRACT

A mountable tool holster is generally disclosed. The mountable tool holster comprises a tool holster and an elongated reinforced backing. The tool holster includes a support arm having a first end spaced apart from a second end. A first leg extends generally perpendicular to the first end and a second leg extends generally perpendicular to the second end. The holster is attached to a front side of the elongated, reinforced backing.

19 Claims, 11 Drawing Sheets

(56) References Cited

U.S. PATENT DOCUMENTS 4,372,468 A * 2/1983 Harvey ..... B25H 3/00 211/70.6
4,390,116 A 6/1983 Fehr
4,408,706 A 10/1983 Hurley
D271,252 S * 11/1983 Sickler ..... D3/228
4,457,462 A * 7/1984 Taormina ..... B25H 3/00 224/269
4,496,088 A 1/1985 Tuthill
4,598,027 A * 7/1986 Johnson ..... A45F 5/02 156/212
4,638,530 A * 1/1987 Perry ..... A45F 5/02 224/904
4,729,473 A * 3/1988 Kulzer ..... B65D 73/0064 206/477
4,747,527 A 5/1988 Trumpower
4,782,535 A 11/1988 Yewer, Jr. et al.
4,790,461 A * 12/1988 Stover ..... A45F 5/00 224/234
4,809,894 A * 3/1989 Viio ..... A45F 5/02 224/248
4,815,640 A 3/1989 Johnson
D300,804 S * 4/1989 Myers ..... D34/5
D302,489 S 8/1989 Stone et al.
D306,521 S * 3/1990 Kenney ..... D3/215
4,917,281 A 4/1990 Ostermiller
4,923,105 A 5/1990 Snyder
4,932,576 A 6/1990 Ashley
4,961,522 A 10/1990 Weber
4,962,873 A 10/1990 Schattel
4,966,321 A 10/1990 Outlaw
D313,120 S * 12/1990 Hohlfeld ..... D3/228
D313,121 S 12/1990 Dise
D313,122 S * 12/1990 De Gray ..... 224/251
4,993,614 A 2/1991 Bonofigl
D316,185 S 4/1991 Seber
D316,186 S 4/1991 Seber
D316,485 S 4/1991 Seber
5,004,136 A 4/1991 Leath
5,014,636 A 5/1991 Seber
D324,309 S 3/1992 Huff
D329,748 S * 9/1992 Ehlin ..... D3/228
D330,806 S * 11/1992 Seber ..... D3/228
D333,040 S 2/1993 Dancyger
D333,215 S 2/1993 Brown
5,195,667 A 3/1993 Gallant
5,201,448 A 4/1993 Schue
5,209,384 A 5/1993 Anderson
5,248,072 A 9/1993 Jones
D348,777 S 7/1994 Dancyger
D348,778 S 7/1994 Dancyger
D348,982 S 7/1994 Dancyger
D348,983 S 7/1994 Dancyger
5,329,884 A 7/1994 Bell
5,337,511 A 8/1994 Ashbaugh
5,337,933 A 8/1994 Nunez
5,341,975 A 8/1994 Marinescu
D350,229 S 9/1994 Dancyger
D350,849 S 9/1994 Dancyger
D355,748 S 2/1995 Dancyger
5,388,740 A 2/1995 Garland
D356,933 S * 4/1995 Barone, Jr. ..... D3/228
D359,848 S * 7/1995 Pounds ..... D3/228
D361,658 S 8/1995 Martin
5,497,923 A 3/1996 Pearson et al.
5,501,379 A 3/1996 Munoz
5,505,356 A 4/1996 Noriega et al.
5,511,703 A 4/1996 Ryerson
5,511,705 A 4/1996 Dreszer
5,531,292 A 7/1996 Bell
D373,243 S * 9/1996 Tovey ..... D3/228
D374,604 S * 10/1996 Hnatowicz ..... D3/228
5,568,887 A 10/1996 Gollihue et al.
D378,633 S 4/1997 Granito
5,630,536 A 5/1997 Bugnaski
5,639,003 A 6/1997 Utzinger
D381,804 S 8/1997 Dancyger
5,653,337 A 8/1997 Cirigliano
5,673,830 A 10/1997 Matthews
D392,826 S * 3/1998 Paikos ..... D6/566
5,730,347 A 3/1998 Finot
D396,405 S * 7/1998 Zaccardelli ..... D8/373
5,813,530 A 9/1998 Kornblatt
D401,462 S * 11/1998 Paikos ..... D6/566
D406,485 S * 3/1999 Paikos ..... D6/566
D406,896 S 3/1999 Dancyger
5,906,350 A * 5/1999 Kao ..... A47F 7/0028 206/349
D329,884 S 6/1999 Case
5,915,610 A 6/1999 Russell
5,941,438 A 8/1999 Price
5,944,242 A * 8/1999 Musarella ..... A45F 5/02 224/270
5,971,101 A 10/1999 Taggart
5,988,315 A 11/1999 Crane
D418,291 S 1/2000 Dancyger
6,015,073 A 1/2000 Wojciak et al.
6,016,944 A 1/2000 Girbert
D423,759 S 5/2000 Dancyger
D423,773 S 5/2000 Dancyger
6,065,658 A 5/2000 Hashimoto
6,070,288 A 6/2000 Luyckx et al.
6,076,669 A * 6/2000 Ling ..... B65D 73/0064 206/349
D428,250 S 7/2000 Reichardt
6,085,952 A 7/2000 Garland
6,102,264 A 8/2000 Redzisz
D431,104 S 9/2000 Dancyger
6,119,909 A 9/2000 Dancyger
6,126,003 A 10/2000 Brouard
D433,930 S * 11/2000 Kalat ..... D8/395
D434,308 S * 11/2000 Kalat ..... D8/395
D434,309 S * 11/2000 Kalat ..... D8/395
6,155,471 A 12/2000 Lichtenberger
6,179,185 B1 1/2001 Dancyger
D437,998 S 2/2001 Williamson
D437,999 S 2/2001 Williamson
6,193,119 B1 2/2001 Schwarm
D438,701 S 3/2001 Dancyger
6,199,736 B1 * 3/2001 Musarella ..... A45F 5/02 224/667
6,213,365 B1 4/2001 Stock et al.
6,216,931 B1 4/2001 Trawinski
D443,411 S 6/2001 Snider et al.
D445,249 S * 7/2001 Russell ..... D3/228
6,267,276 B1 7/2001 Cook
D448,162 S 9/2001 Snider
D450,449 S 11/2001 Godshaw et al.
D452,071 S * 12/2001 Snider ..... D3/228
D452,610 S * 1/2002 Schwartzmiller ..... D3/228
D453,069 S * 1/2002 Smith ..... D3/228
D455,901 S 4/2002 Snider
6,390,348 B1 5/2002 Godshaw et al.
6,398,092 B1 6/2002 Ansley
6,425,511 B1 * 7/2002 Dodson ..... B25H 3/006 224/242
6,435,389 B1 8/2002 Sucher
D463,115 S 9/2002 Snider
6,446,852 B1 9/2002 Sorensen et al.
D463,664 S 10/2002 Borsuk
D464,794 S * 10/2002 Dancyger ..... D3/228
6,478,463 B2 11/2002 Snider
6,487,756 B1 12/2002 Vidal
6,536,590 B1 3/2003 Godshaw et al.
6,550,592 B1 4/2003 Godshaw et al.
6,561,402 B2 5/2003 Holland et al.
6,568,575 B1 5/2003 Bartholomew
D477,142 S 7/2003 Dancyger
D477,462 S 7/2003 Dancyger
6,592,012 B2 7/2003 Godshaw et al.
6,601,743 B2 8/2003 Godshaw
D481,535 S 11/2003 Cabrera et al.
D482,196 S 11/2003 Cabrera et al.
D482,524 S 11/2003 Cabrera et al.

(56) References Cited

U.S. PATENT DOCUMENTS 6,641,011 B1 11/2003 Kahn
D483,939 S * 12/2003 Kountz ..... D3/215
6,655,565 B2 12/2003 Godshaw et al.
6,659,321 B2 12/2003 Hartranft et al.
6,662,373 B2 12/2003 Frank
6,675,965 B2 1/2004 Holland et al.
D487,630 S 3/2004 Martin et al.
6,698,632 B1 3/2004 Turner et al.
6,701,534 B2 3/2004 Guibord
6,712,251 B2 3/2004 Godshaw et al.
D492,478 S * 7/2004 Hadley ..... D3/220
6,766,532 B1 7/2004 Cabana
D496,787 S 10/2004 Cabrera et al.
D501,078 S 1/2005 Cabana
6,837,373 B2 * 1/2005 Huang ..... A45F 5/021 206/376
6,848,605 B2 2/2005 Dillenberger
6,874,630 B2 * 4/2005 Lin Wu ..... A47F 7/024 206/349
6,889,834 B2 5/2005 Ho
6,907,989 B2 6/2005 Ho
6,915,902 B2 7/2005 Brouard
6,935,516 B2 * 8/2005 Chiang ..... B65D 73/0064 206/349
D510,258 S * 10/2005 Glass ..... D8/373
6,991,104 B2 1/2006 Redzisz
6,994,238 B2 2/2006 Estabaya
D516,899 S * 3/2006 Anderson ..... D8/367
7,011,241 B2 3/2006 Godshaw et al.
7,055,652 B1 6/2006 Williams
7,077,303 B2 7/2006 Zega
D528,785 S 9/2006 Fraga
D530,506 S 10/2006 Thurner
D530,908 S * 10/2006 Westcott ..... D3/228
D531,401 S 11/2006 Thurner
D531,799 S 11/2006 Adams et al.
7,150,345 B2 12/2006 Redzisz
D543,025 S 5/2007 Cicione
D543,441 S * 5/2007 Hall ..... D8/367
7,219,807 B2 * 5/2007 Kao ..... B29C 33/005 206/376
D545,669 S * 7/2007 Hall ..... D8/367
D546,558 S * 7/2007 Albert ..... D3/228
7,243,793 B2 7/2007 Ho
D552,345 S * 10/2007 Albert ..... D3/228
D553,350 S 10/2007 Dvorak
D553,362 S 10/2007 Godshaw et al.
7,293,635 B2 11/2007 Repke et al.
7,314,153 B2 1/2008 Musarella et al.
7,318,542 B2 1/2008 Godshaw et al.
D564,222 S * 3/2008 Slavov ..... D3/228
D565,396 S * 4/2008 Wipf ..... D8/367
D581,657 S * 12/2008 Rice ..... D3/228
D588,800 S 3/2009 Cicione
D603,164 S 11/2009 Meier et al.
7,658,307 B2 2/2010 Skupin
7,699,197 B2 4/2010 Panosian et al.
7,784,658 B1 8/2010 Hansen
7,802,680 B2 9/2010 Krebs et al.
D628,382 S 12/2010 Niehaus et al.
7,909,214 B2 3/2011 Gold et al.
D641,552 S 7/2011 Sosnovsky
7,984,820 B2 7/2011 Dancyger
D642,898 S * 8/2011 Slavov ..... D8/370
8,016,173 B2 9/2011 Dvorak
D647,301 S 10/2011 Sosnovsky
8,032,980 B2 10/2011 Basenberg et al.
D648,121 S 11/2011 Dallmann
D648,532 S 11/2011 Sosnovsky
D648,533 S 11/2011 Sosnovsky
D650,577 S * 12/2011 Glander ..... D3/228
8,074,798 B2 12/2011 Williams et al.
8,151,938 B2 4/2012 Kinskey
8,152,037 B2 4/2012 Sabbag
8,177,029 B1 5/2012 Norton et al.
8,220,683 B2 7/2012 Williams
D667,636 S 9/2012 Maglieri
D672,280 S 12/2012 Schurian et al.
D672,556 S 12/2012 Scarabelli
D672,962 S 12/2012 Wang et al.
D676,234 S 2/2013 Moreau et al.
8,376,665 B2 2/2013 Kirby
8,381,920 B2 * 2/2013 Chang ..... B65D 73/0021 211/113
8,382,373 B1 2/2013 Dancyger
8,403,140 B2 3/2013 Woolery
8,403,141 B2 3/2013 Williams et al.
D684,764 S 6/2013 Sigouin
D696,012 S 12/2013 Hanlon
D697,573 S * 1/2014 Smith ..... D22/107
D699,940 S 2/2014 Robert
D701,045 S 3/2014 Menirom et al.
D703,438 S 4/2014 Lee
8,708,351 B2 4/2014 Kinskey et al.
D704,435 S 5/2014 Moreau et al.
D707,962 S 7/2014 Moreau et al.
D714,542 S * 10/2014 Barragan ..... D3/228
D715,549 S 10/2014 Moreau et al.
8,875,314 B1 11/2014 Panetta
D723,266 S * 3/2015 Kinskey ..... D3/228
D739,139 S * 9/2015 Kinskey ..... D3/228
9,126,328 B2 * 9/2015 Brandeis ..... A45F 5/02
9,144,291 B2 * 9/2015 Huang ..... A45F 5/021
9,173,475 B2 * 11/2015 Blechman ..... A45F 5/02
D744,233 S * 12/2015 Hassler ..... D3/228
D749,403 S * 2/2016 Ericsson ..... D8/380
9,249,003 B2 * 2/2016 Reeves ..... B66F 13/00
2001/0035736 A1 11/2001 Person
2002/0008128 A1 1/2002 Field
2002/0014507 A1 2/2002 Snider et al.
2002/0096545 A1 7/2002 Chang
2002/0145027 A1 10/2002 Godshaw et al.
2002/0170933 A1 11/2002 Martin
2003/0042160 A1 3/2003 Godshaw et al.
2003/0102346 A1 6/2003 Chen
2003/0197042 A1 10/2003 Warren
2003/0213827 A1 11/2003 Langmuir
2004/0040991 A1 * 3/2004 McCoy ..... A45F 5/00 224/251
2004/0245305 A1 12/2004 Garcia
2005/0082323 A1 4/2005 O'Hair
2005/0133561 A1 6/2005 Kimball
2005/0236454 A1 10/2005 Godshaw et al.
2006/0070901 A1 4/2006 Adams et al.
2006/0102674 A1 5/2006 Godshaw et al.
2006/0102678 A1 5/2006 Bommarito
2006/0144885 A1 7/2006 Smeuninx
2006/0206992 A1 9/2006 Godshaw et al.
2006/0261116 A1 11/2006 Brandeis
2006/0266782 A1 11/2006 Godshaw et al.
2006/0289585 A1 12/2006 Godshaw et al.
2007/0007156 A1 * 1/2007 Wu ..... B65D 73/0064 206/376
2007/0025647 A1 2/2007 Hamlin
2007/0045372 A1 3/2007 Cangemi
2007/0058887 A1 3/2007 Godshaw et al.
2007/0062997 A1 3/2007 Thurner
2007/0125819 A1 6/2007 Kahn
2007/0138227 A1 6/2007 Rickman
2007/0170220 A1 7/2007 Fragassi
2007/0241014 A1 10/2007 Williams
2007/0241158 A1 10/2007 Shima
2007/0241159 A1 10/2007 Chang
2007/0295776 A1 12/2007 Whelan
2008/0017683 A1 1/2008 Votel
2008/0023515 A1 1/2008 Coonan et al.
2008/0029562 A1 2/2008 Hawkins et al.
2008/0093406 A1 4/2008 Logan et al.
2008/0135594 A1 6/2008 Williams
2008/0179370 A1 7/2008 Williams
2008/0185414 A1 8/2008 Conlon
2008/0197756 A1 8/2008 Macias et al.
2008/0202962 A1 8/2008 Brouard
2008/0240624 A1 10/2008 Godshaw et al.

(56) References Cited

U.S. PATENT DOCUMENTS

| | | | | |
|---|---|---|---|---|
| 2008/0264992 | A1 | 10/2008 | Westling | |
| 2008/0314947 | A1 | 12/2008 | Gold et al. | |
| 2009/0078730 | A1 | 3/2009 | Kuny et al. | |
| 2009/0108040 | A1 | 4/2009 | Corzine | |
| 2009/0145711 | A1 | 6/2009 | Panosian et al. | |
| 2009/0145938 | A1 | 6/2009 | Kahn | |
| 2009/0242598 | A1 | 10/2009 | Dormaar | |
| 2009/0294500 | A1 | 12/2009 | Brown et al. | |
| 2009/0314813 | A1 | 12/2009 | Woolery | |
| 2010/0044405 | A1 | 2/2010 | Albert | |
| 2010/0072242 | A1 | 3/2010 | Panosian et al. | |
| 2010/0176171 | A1 | 7/2010 | Araujo | |
| 2011/0089057 | A1 | 4/2011 | Miller et al. | |
| 2011/0132953 | A1 | 6/2011 | Kreitzer | |
| 2011/0139837 | A1* | 6/2011 | Davis | A45F 5/02 224/269 |
| 2011/0176752 | A1 | 7/2011 | Williams et al. | |
| 2012/0055894 | A1 | 3/2012 | Cabana et al. | |
| 2012/0085802 | A1 | 4/2012 | Ferrante | |
| 2012/0138496 | A1 | 6/2012 | Tonelli | |
| 2012/0145755 | A1 | 6/2012 | Kahn | |
| 2012/0168472 | A1 | 7/2012 | Mathews | |
| 2013/0008933 | A1 | 1/2013 | Clifford | |
| 2013/0048419 | A1 | 2/2013 | Nicholas, Jr. | |
| 2013/0119100 | A1 | 5/2013 | Ito et al. | |
| 2013/0119101 | A1 | 5/2013 | Hachisuka | |
| 2013/0248284 | A1 | 9/2013 | Nichols | |
| 2013/0299544 | A1 | 11/2013 | Moreau et al. | |
| 2014/0166516 | A1 | 6/2014 | Martinez et al. | |
| 2014/0190852 | A1 | 7/2014 | Kinskey et al. | |
| 2014/0239024 | A1 | 8/2014 | Brouard et al. | |
| 2014/0262861 | A1 | 9/2014 | Crowe et al. | |
| 2015/0122856 | A1* | 5/2015 | Pecotte | A45F 5/00 224/268 |
| 2015/0237999 | A1* | 8/2015 | Kinskey | A45F 5/021 224/660 |
| 2015/0238000 | A1* | 8/2015 | Kinskey | A45F 5/021 224/660 |

* cited by examiner

AIR GUN HOLSTER POUCH AND METHOD OF USING THE SAME

RELATED APPLICATIONS

This application claims priority to U.S. Application Ser. No. 62/001,664, "Air Gun Holster Pouch and Method of Using the Same," filed May 22, 2014, and U.S. Application Ser. No. 61/942,854, "Hand Tool Toolbelt," filed Feb. 21, 2014, each of which is incorporated herein by reference in its entirety.

FIELD OF THE INVENTION

The present invention relates generally to tool holders, namely, air gun holster pouches, and methods of using the same.

BACKGROUND

Air guns are common tools used in many fields, such as, for example, construction, manufacturing, and automotive production. Examples of air guns include nail guns, staple guns, impact guns, pneumatic tools, and other air-operated equipment. Air guns may have significant weight and must be carried by workers over extended shifts. Workers frequently secure air guns to hammer holders or other improvised devices, which can lead to accidents where the air gun falls or causes the worker to lose his balance.

SUMMARY

In one embodiment, a mountable tool holster is disclosed. The mountable tool holster comprises a tool holster and an elongated reinforced backing. The tool holster includes a support arm having a first end spaced apart from a second end. A first leg extends generally perpendicular to the first end and a second leg extends generally perpendicular to the second end. The holster is attached to a front side of the elongated, reinforced backing.

In one embodiment, a mountable tool holster is disclosed. The mountable tool holster comprises a tool holster and an elongated, reinforced backing. The tool holster includes a support arm having a first end spaced apart from a second end. A first leg extends generally perpendicular to the first end and a second leg extends generally perpendicular to the second end. The holster is attached to a front side of the elongated, reinforced backing. An upper edge of the support arm is above the midpoint of a major axis of the elongated reinforced backing. A back side of the elongated reinforced backing comprises a padding system. The padding system includes a first resilient component with a rubberized outer face and a second resilient component with a fabric covered outer face. An upper portion of a backside of the elongated, reinforced backing comprises a clip, a belt sleeve, or both.

These and other features, objects and advantages of the present invention will become more apparent to one skilled in the art from the following description and claims when read in light of the accompanying drawings.

DETAILED DESCRIPTION

Figure 1:
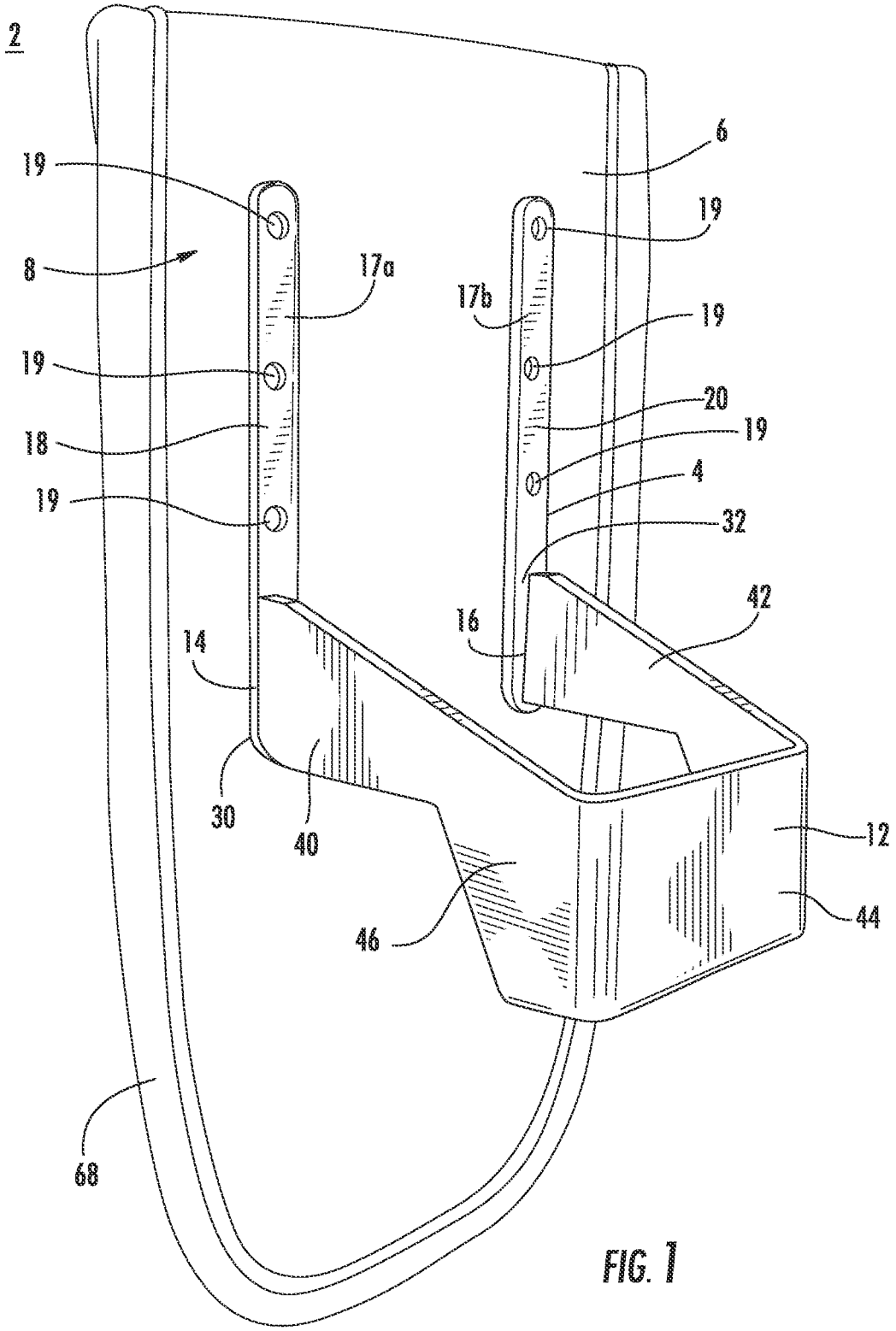
FIG. 1 is a front, perspective view of an embodiment of an air gun holster pouch as described herein.

As shown in FIGS. 1-14, an air gun holster pouch 2 adapted for attachment to a piece of material, such as a belt, a waist band, or the lip of a pocket, is described. The air gun holster pouch 2 can be removably attached to the piece of material using a clip 60 on the back side of the air gun holster pouch 2 or by sliding a belt through a belt sleeve 62 that is part of the air gun holster pouch 2. This enables a worker to removably couple the tool holder 2 over the waist of their pants, their belt, or over a pocket of a tool pouch or tool box. The air gun holster pouch 2 can include a support arm 12 that is specially adapted for supporting an air gun; an elongated, reinforced backing for protecting the wearer from a mounting bracket attached to an air gun; and a belt sleeve or clip for supporting the air gun holster pouch 2.

In some embodiments, the air gun holster pouch 2 includes a holster 4 that includes a support arm 12, having a first end 14 spaced apart from a second end 16; a first leg 18 extending generally perpendicular to the first end 14; and a second leg 20 extending generally perpendicular to the second end 16. The air gun holster pouch 2 also includes an elongated, reinforced backing 6, wherein the holster 4 is attached to a front side 8 of the elongated, reinforced backing 6.

As used herein, "generally" is indicated to cover minor variations from a direction. For example, generally can include the direction (e.g., perpendicular or parallel) and deviations from the direction of ±10 degrees, or ±5 degrees, or ±2.5 degrees.

In some embodiments, the first leg 18 is coupled to the first end 14 at a lower end 30 of the first leg 18. In some embodiments, the second leg 20 is coupled to the second end 16 at a lower end 32 of the second leg 20. In some embodiments, the first leg 18 and the second leg 20 are generally parallel.

Figure 2:
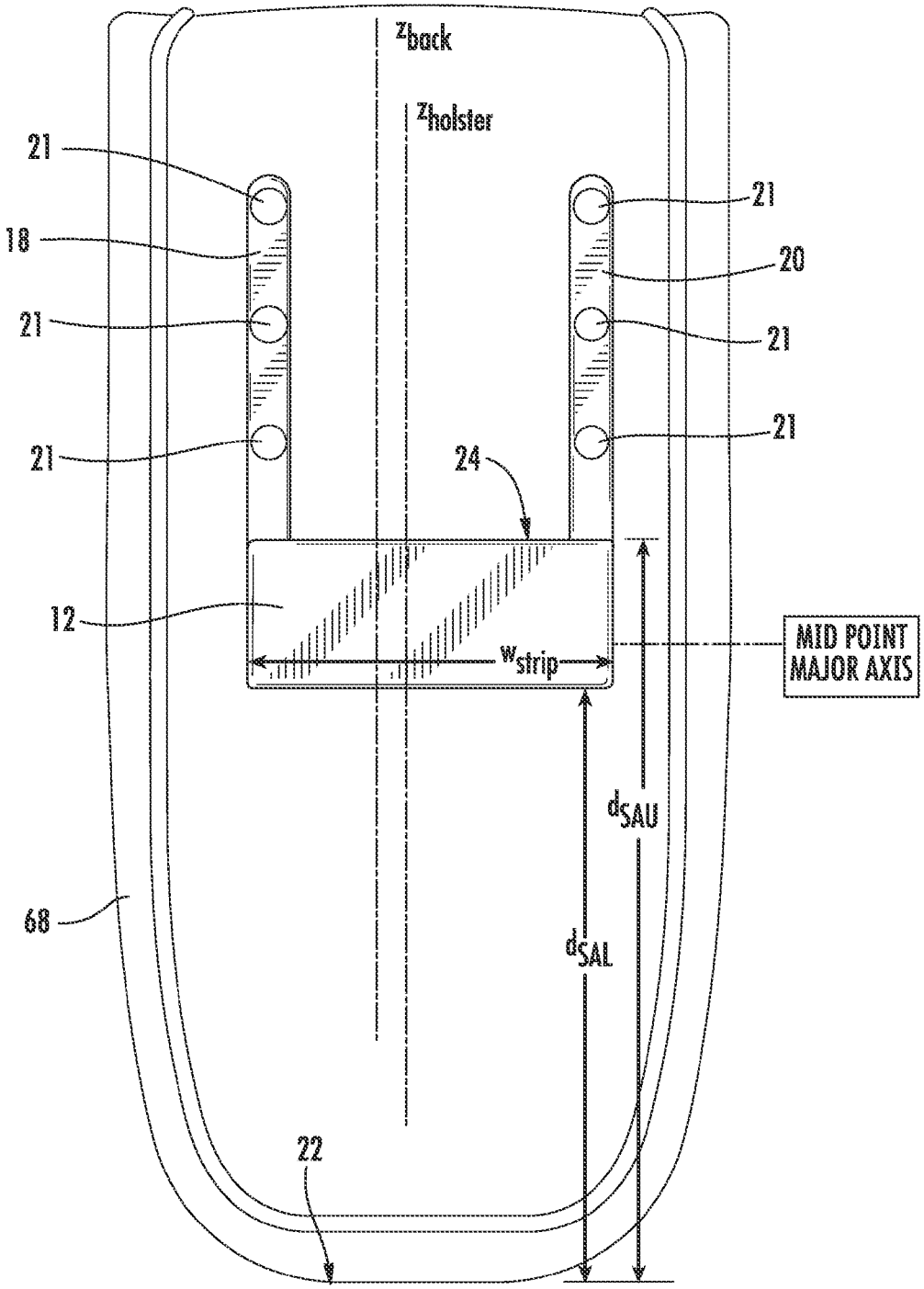
FIG. 2 is a front view of the air gun holster pouch.

In some embodiments, the first leg 18, the second leg 20, or both 18, 20, include an attachment portion 17*a*, 17*b*, having a generally rectangular cross-section. In some embodiments, the first leg 18, the second leg 20, or both 18, 20 can include at least one orifice 19, or at least two orifices 19, or at least three orifices 19, in the attachment regions 17*a*, 17*b*, respectively. As shown in FIG. 2, the holster 4 can be attached to the elongated, reinforcing backing 6 by rivets 21 that pass through the orifices 19 and one or more components of the elongated, reinforcing backing 6 (e.g., the reinforcing member 76).

Figure 3:
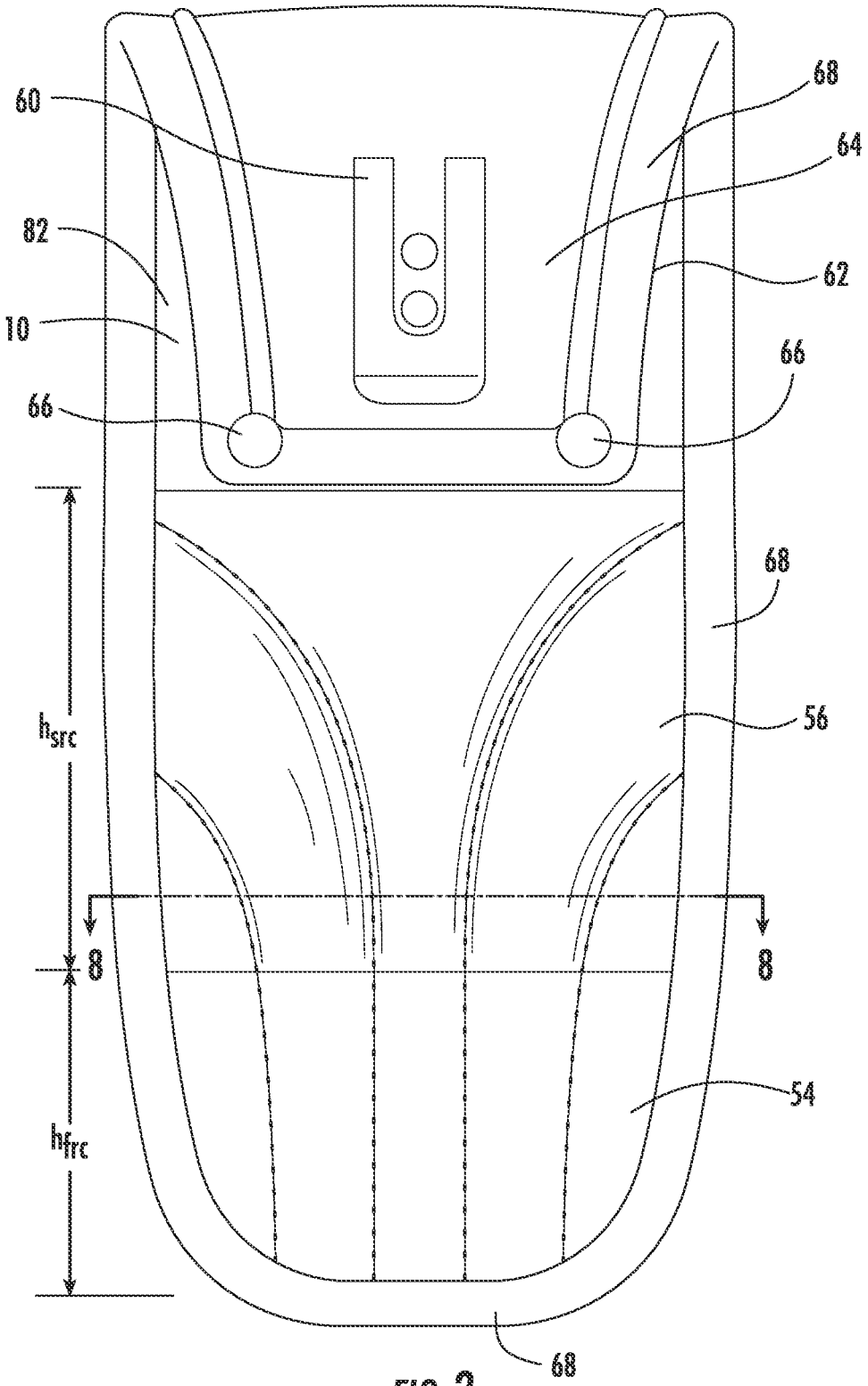
FIG. 3 is a back view of the air gun holster pouch

In some embodiments, as shown in FIG. 2, the major axis ($Z_{back}$) of the elongated, reinforced backing 6 and a major axis ($Z_{holster}$) of the tool holster 4 are generally parallel. In some embodiments, the major axes ($Z_{back}$, $Z_{holster}$) are parallel. In some embodiments, as shown in FIGS. 2 & 3, the air gun tool holster 2 is symmetric along a vertical axis.

Figure 6:
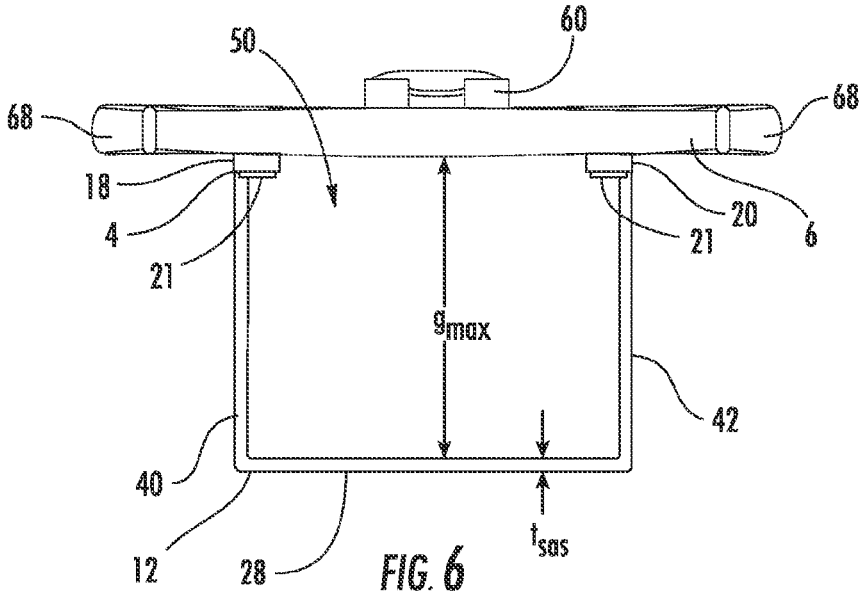
FIG. 6 is a top view of an air gun holster pouch where the support arm strip is the transverse member.
Figure 13:
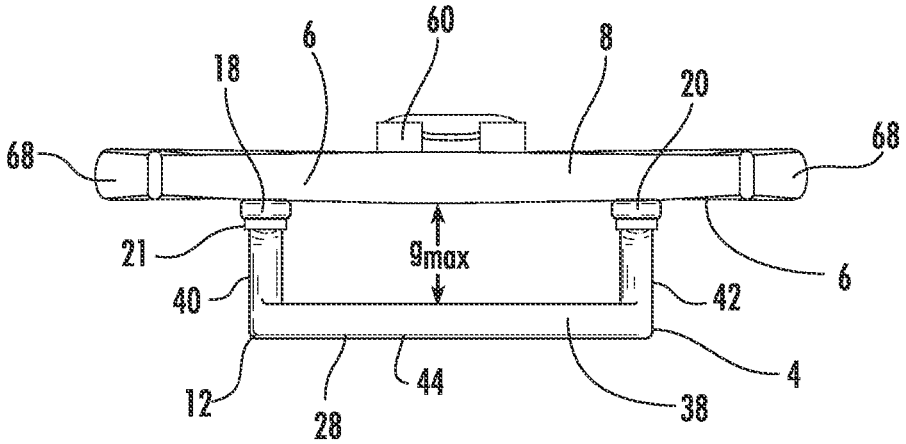
FIG. 13 is a top view of an air gun holster pouch where the support arm includes a continuous support arm bar.

In some embodiments, as shown in FIGS. 6 & 13, the maximum gap ($g_{max}$) between the support arm 12 and the elongated, reinforced backing 6 is 2 inches or less. In some embodiments, the maximum gap ($g_{max}$) is 1.5 inches or less, or 1.25 inches or less, or 1 inch or less.

In some embodiments, as shown in FIG. 2, a distance ($d_{SAU}$) between a bottom edge 22 of the elongated, reinforced backing 6 and an upper edge 24 of the support arm 12 is at least 3 inches. In some embodiments, the distance ($d_{SAU}$) between a bottom edge 22 of the elongated, reinforced backing 6 and an upper edge 24 of the support arm 12 is at least 3.5 inches, or is at least 4 inches, or is at least 4.5 inches, or is at least 5 inches, or is at least 5.5 inches. In some embodiments, the distance ($d_{SAU}$) is 12 inches or less, or 11 inches or less, or 10 inches or less, or 9 inches or less, or 8 inches or less, or 7 inches or less. In some embodiments, the distance ($d_{SAU}$) comprises a majority of a total length of the reinforced backing 6.

In some embodiment, as shown in FIG. 2, the upper edge 24 of the support arm 12 is above the midpoint of a major axis (i.e., $Z_{back}$) of the elongated, reinforced backing 6.

In some embodiments, a distance ($d_{SAL}$) between a bottom edge 22 of the elongated, reinforced backing 6 and a lower edge 26 of the support arm 12 is at least 2.5 inches. In some embodiments, the distance ($d_{SAL}$) between a bottom edge 22 of the elongated, reinforced backing 6 and an lower edge 26 of the support arm 12 is at least 3 inches, or is at least 3.5 inches, or is at least 4 inches, or is at least 4.25 inches, or is at least 4.5 inches. In some embodiments, the distance ($d_{SAL}$) is 8 inches or less, or 7 inches or less, or 6 inches or less.

In some embodiments, a back side 10 of the elongated, reinforced backing 6 comprises a padding system 52, comprising first resilient component 54 and a second resilient component 56. The first resilient component 54 can be at a lower end of the elongated, reinforced backing 6, while the second resilient component 56 can be adjacent to, and above, the first resilient component 54.

The first resilient component 54 can be formed of a rubber material. Examples of rubber materials include, but are not limited to, natural rubber, styrene-butadiene rubber, nitrile rubber, neoprene rubber, silicone rubber, ethylene propylene diene monomer (EPDM) rubber, or combinations thereof. An outer surface of the first resilient component 54 can be the raw rubber sheet in order to provide a no-slip surface and enhance the user's control of the air gun supported in the air gun holster pouch 2.

The height ($h_{frc}$) of the first resilient component 54 can be at least 1 inch, or at least 1.5 inches, or at least 1.75 inches, or at least 2 inches. The height ($h_{frc}$) of the first resilient component 54 can be 4 inches or less, or 3.5 inches or less, or 3 inches or less, or 2.5 inches or less.

The second resilient component 56 can extend above the first resilient component 54. In some embodiments, the first resilient component 54 and the second resilient component 56 overlap less than 1 inch, or less than 0.5 inches, or less than 0.25 inches.

In some embodiments, the second resilient component 56 can be formed of a rubber or foam with a fabric backing exposed. The rubber or foam material can be formed of a material selected from, but not limited to, natural rubber, styrene-butadiene rubber, nitrile rubber, neoprene rubber, silicone rubber, ethylene propylene diene monomer (EPDM) rubber, or combinations thereof. The fabric backing can be formed of a woven material comprising nylon, Lycra®, Spandex®, combinations thereof, and other suitable materials.

The height ($h_{src}$) of the second resilient component 56 can be at least 1 inch, or at least 1.5 inches, or at least 2 inches, or at least 2.5 inches, or at least 3 inches. The height ($h_{src}$) of the second resilient component 56 can be 6 inches or less, or 5.5 inches or less, or 5 inches or less, or 4.5 inches or less, or 4 inches or less.

In some embodiments, the upper, back portion of the air gun holster pouch 2 includes a belt clip 60, a belt sleeve 62, or both 60, 62. In some embodiments, the belt clip 60 can be attached to a belt sleeve flap 64. In some embodiments, the belt sleeve flap 64 extends from a top of the elongated, reinforced backing 6. A proximal end of the belt sleeve flap 64 can be folded while a distal end of the belt sleeve flap can be secured to the elongated, reinforced backing 6. In some embodiments, the belt sleeve flap 64 can be secured to the elongated, reinforced backing by belt sleeve rivets 66. In some embodiments, a belt sleeve rivet 66 can be the same rivet 21 that passes through one of the orifices 19 in the first or second legs 18, 20. For example, in some embodiments, the belt sleeve rivet 66 can pass through the lowest orifice 19 in the respective legs 18, 20.

In some embodiments, a continuous binding 68 can extend along the perimeter of the elongated, reinforced backing 6 and the belt sleeve flap 64. This is clearly shown in the various views of FIGS. 1-14.

Figure 8:
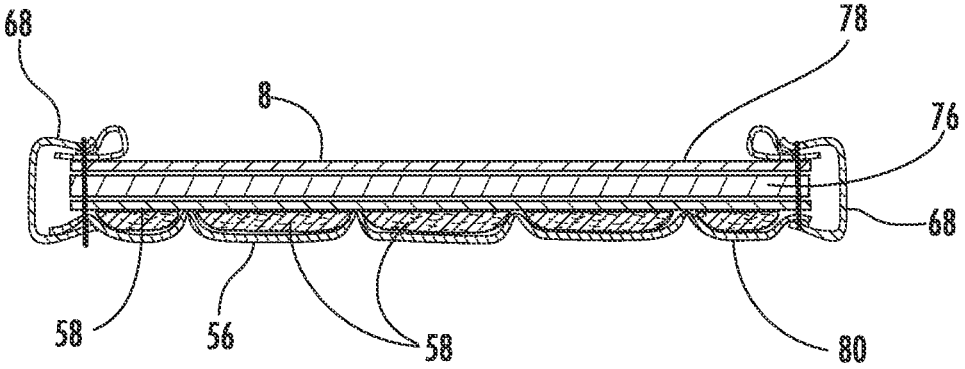
FIG. 8 is a cross-sectional view of the air gun holster pouch of FIG. 3 taken along cut line 8-8.

As shown in FIG. 8, the reinforced backing 6 can include a reinforcing member 76 sandwiched between a front facing 78 and a back facing 80. In some embodiments, the front facing 78 can be a woven material or a non-woven material. For example, in some embodiments, the front facing 78 can be a fabric material, such as nylon fabric.

In some embodiments, the back facing 80 can be a woven material or a non-woven materials. For example, the back facing 80 can be a series of materials with the first resilient component 54 at the bottom, the second resilient component 56 in the middle, and a fabric material 82 at the top of the back facing. As shown in FIG. 8, in some embodiments, portions of the second resilient component 56 can be sewn to a foam sheet 58 extending between the second resilient material 56 and the reinforcing member 76.

In some embodiments, the reinforcing member 76 can be a sheet of material formed of plastic, wood, metal, or a combination thereof. Where the reinforcing member 76 is a plastic sheet or board, the reinforcing member can be formed of a material including, but are not limited to, polyethylene (PE), polypropylene (PP), polystyrene (PS), polyesters, combinations thereof, and other durable polymer materials. In some embodiment, the reinforcing member 76 can be sheet with a thickness of at least 1/32", or at least 1/16", or at least 3/32". In some embodiment, the reinforcing member 76 can be sheet with a thickness of 1/4" or less, or 3/16" or less, or 5/32" or less, or 1/8" or less. The thickness of the reinforcing member 76 can be such that the reinforcement member 76 maintains a substantially planar shape when placed under an appropriate load.

In some embodiments, the reinforced backing 8 is designed to bow or deform when placed under a load typically experienced during use (e.g., with an air gun hanging from the support arm 12). When under load (e.g., from an air gun), the reinforced backing 8 can bow away from a user, causing the air gun holster pouch 2 to have a concave shape with respect to the user. The concave shape of the deformed air gun holster pouch 2 allows air flow behind the air gun holster pouch 2 to cool the user's skin under the air gun holster pouch 2. In some embodiments, the reinforcing member 76 is omitted.

In some embodiments, as shown in FIG. 6, an intermediate portion 28 of the support arm 12 is generally parallel to the elongated, reinforced backing 6. In some embodiments, the intermediate portion 28 is linear. The intermediate portion 28 can be linear for at least 0.5 inches, or at least 0.75 inches, or at least 1 inch, or at least 1.25 inches, or at least 1.5 inches, or at least 1.75 inches, or at least 2 inches.

In some embodiments, the holster 4 can be formed of a single piece of material. In some embodiments, both legs 18, 20 and the support arm 12 are formed from a single piece of material. For example, the holster 4 can be formed (e.g., cast, molded, or punched) as a single piece. In some embodiments, as shown in FIG. 2, the tool holder 2 is symmetric along a vertical axis ($Z_{holster}$).

In some embodiments, the first leg 18 is coupled to the first end 14 at a lower end 30 of the first leg 18, and the second leg 20 is coupled to the second end 16 at a lower end 32 of the second leg 20.

In some embodiments, the support arm 12 comprises a support arm strip 36 having a uniform support arm strip thickness ($t_{SAS}$). In some embodiment, the support arm strip 36 does not extend the entire length of the support arm 12. As used herein, "uniform thickness" refers to an average thickness plus or minus a tolerance of less than 10% or less than 0.1".

In some embodiments, the support arm strip 36 can be 0.5 to 4 inches wide ($w_{strip}$). In some embodiments, the support arm strip 36 can be at least 0.75 inches wide, or at least 1 inch wide, or at least 1.5 inches wide. In some embodiments, the support arm strip 36 can be 3.5 inches wide or less, or 3.25 inches wide or less, or 3 inches wide or less.

Figure 7:
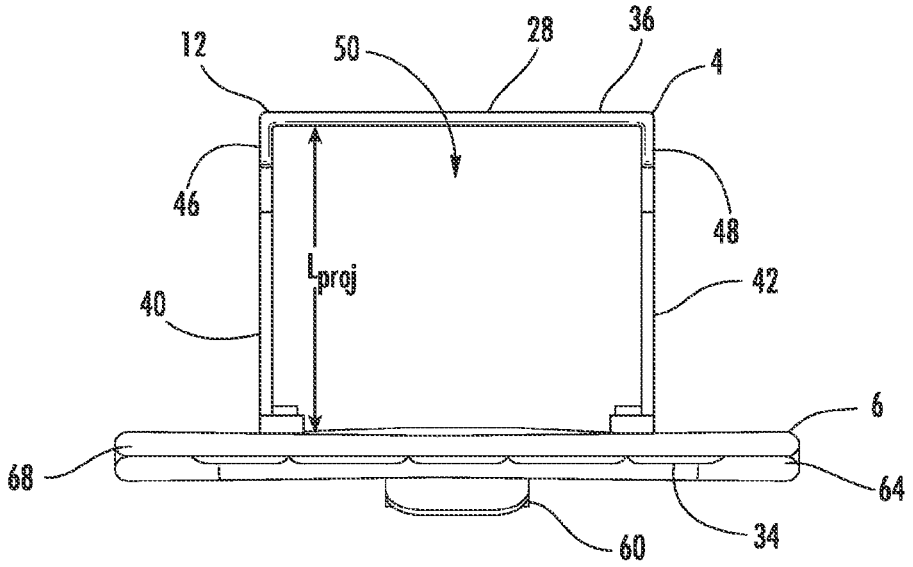
FIG. 7 is a bottom view of the air gun holster pouch of FIG. 6.

In some embodiments, the support arm 12 comprises a first support arm side 40 extending generally perpendicular from the first leg 18 and a second support arm side 42 extending generally perpendicular from the second leg 20. The support arm strip 36 extends from a distal end of the first support arm side 40 to a distal end of the second support arm side 42. The portion of the support arm strip 36 extending from the first support arm side 40 to the second support arm side 42, can be perpendicular to both the first support arm side 40 and the second support arm side 42. As shown in FIGS. 6-7, in some embodiments, the support arm strip 36 extends generally parallel to the elongated, reinforced backing 8.

In some embodiments, the length ($L_{proj}$) of the first support arm side 40 and the second support arm side 42 can, independently, be between 0.25 inches and 2.5 inches. In some embodiments, the length ($L_{proj}$) of the first support arm side 40 and the second support arm side 42 can, independently, be at least 0.25 inches, at least 0.5 inches, at least 0.75 inches, or at least 1 inch. In some embodiments, the length ($L_{proj}$) of the first support arm side 40 and the second support arm side 42 can, independently, be 3 inches or less, 2.5 inches or less, 2 inches or less, 1.75 inches or less, 1.5 inches or less, or 1.125 inches or less, or 1 inch of less.

Figure 14:
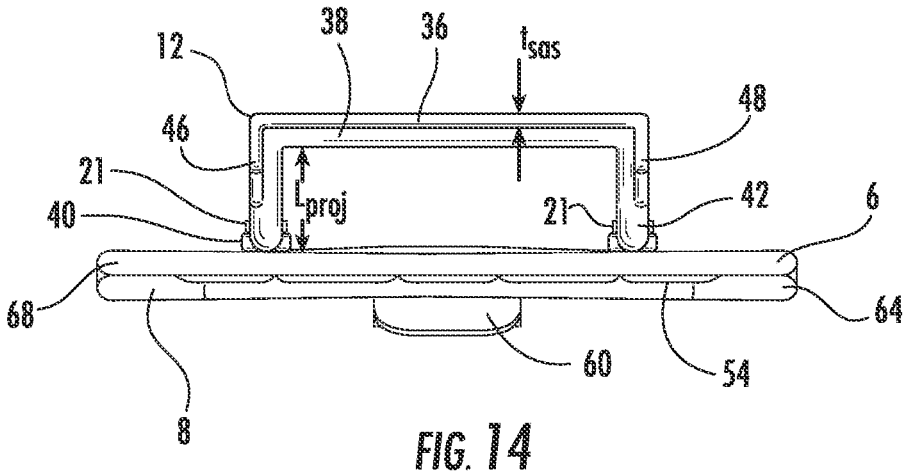
FIG. 14 is a bottom view of the air gun holster pouch of FIG. 12.

In some embodiments, as evident from FIGS. 6 & 7, the support arm strip 36 has a uniform support arm strip thickness ($t_{SAS}$), where the support arm strip 36 extends from the first support arm side 40 to the second support arm side 42. In some embodiments, the first support arm side 40 and the second support arm side 42 have the same uniform thickness ($t_{SAS}$) as the support arm strip 36. In some embodiments, the support arm strip 36 extends generally perpendicular to the first support arm side 40 and the second support arm side 42. In some embodiments, as shown in FIG. 14, the first support arm side 40, the second support arm side 42, and the transverse member 44 are all formed from a single bar, while the support art strip 36 extends down from the first support arm side 40, the second support arm side 42, and the transverse member 44.

As shown in FIGS. 6-7, in some embodiments, the support arm 12 includes a first support arm side 40 extending generally perpendicular from the first leg 18 and a second support arm side 42 extending generally perpendicular from the second leg 20, where the support arm strip 36 extends from a distal end of the first support arm side 40 to a distal end of the second support arm side 42. In some embodiments, the first support arm side 40, the second support arm side 42, and the support arm strip 36 are not formed from a strip of material with a generally uniform cross-section, rather the support arm strip 36 is a sheet with a generally uniform cross-section (rectangle). In such embodiments, a first support arm strip side 46 extends along the first support arm side 40, a second support arm strip side 48 extends along the second support arm side 42 and an intermediate portion of the support arm strip 36 extends from the first support arm side 40 to the second support arm side 42.

As shown in the figures, the support arm strip 36 can be generally flat (i.e., generally planar with a uniform thickness). The support arm strip 36 can have a height ($h_{SAS}$) of 0.5 to 6 inches, in some embodiments. In some embodiments, the support arm strip height ($h_{SAS}$) can be at least 0.5 inches, or at least 0.75 inches, or at least 1 inch, or at least 1.125 inches, or at least 1.25 inches. In some embodiments, the support arm strip height ($h_{SAS}$) can be 5 inches or less, or 4 inches or less, or 3 inches or less, or 2 inches or less. In some embodiments, the support arm strip height ($h_{SAS}$) can be generally uniform between the first support arm side 40 and the second support arm side 42.

Figure 4:
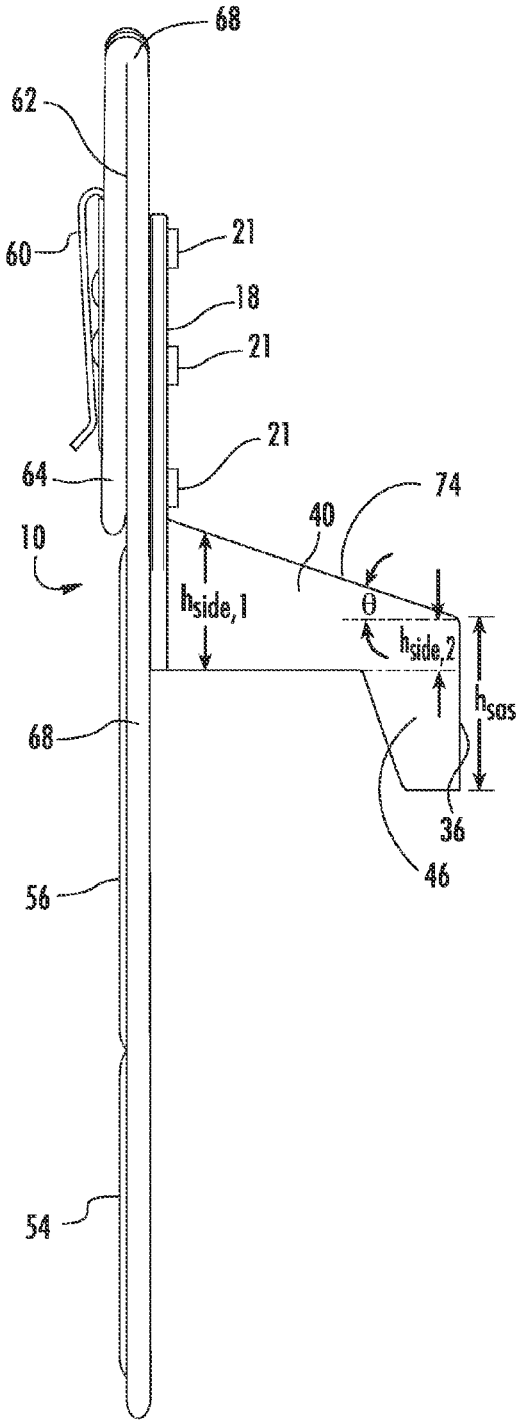
FIG. 4 is a left side view of an air gun holster pouch as described herein.
Figure 5:
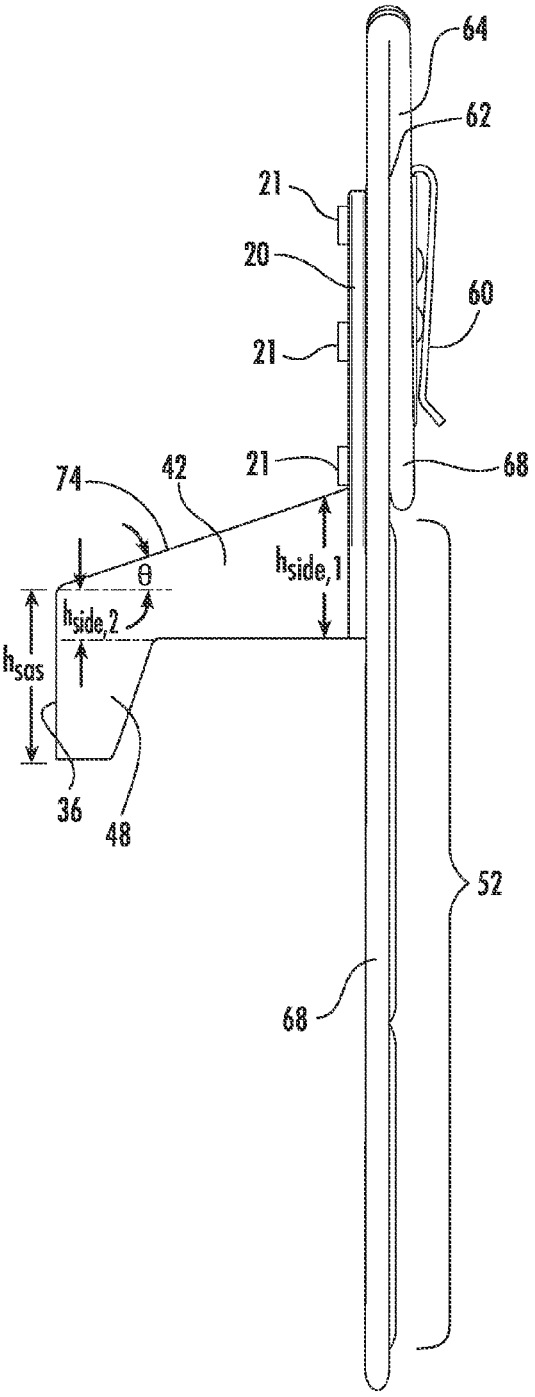
FIG. 5 is a right side view of an air gun holster pouch as described herein.

As best shown in FIGS. 4 & 5, the support arm strip sides 46, 48 can include angled edges. This can be particularly helpful for maintaining an air gun attached to the clip-on air gun holster 2 in a readily accessible position.

Figure 11:
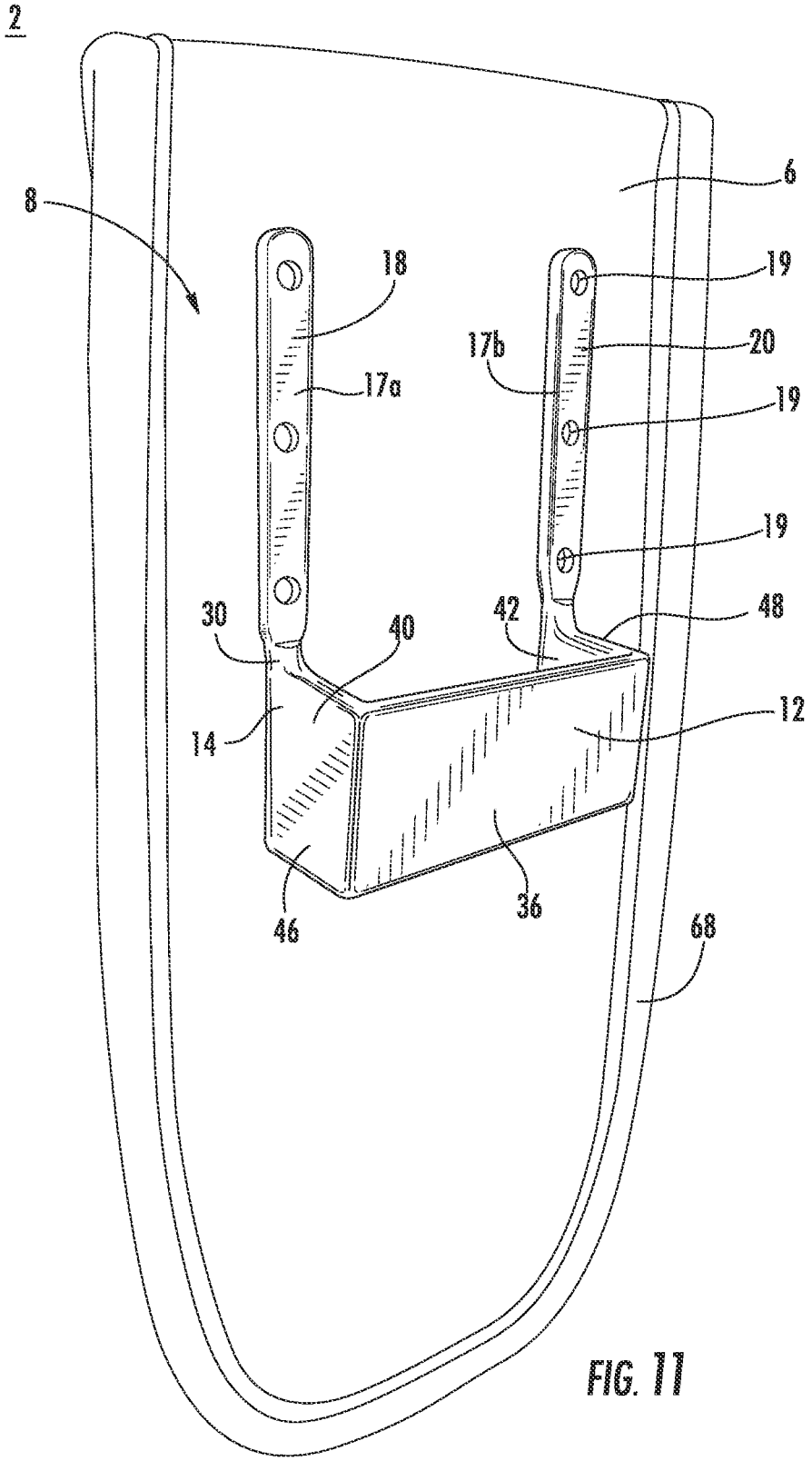
FIG. 11 is a front, perspective view of an embodiment of an air gun holster pouch as described herein, where the support arm strip extends continuously from the first leg to the second leg of the holster.

In some embodiments, as shown in FIG. 11, the support arm strip sides 46, 48 can be attached directly to the first and second legs 18, 20, such that the support arm strip sides 46, 48 are the first and second support arm sides 40, 42. In some embodiments, the support arm strip sides 46, 48 are the first and second support arm sides 40, 42. In some embodiments, the support arm strip sides 46, 48 are coupled to first and second support arm sides 40, 42, which can be part of a continuous support arm strip 36.

Figure 12:
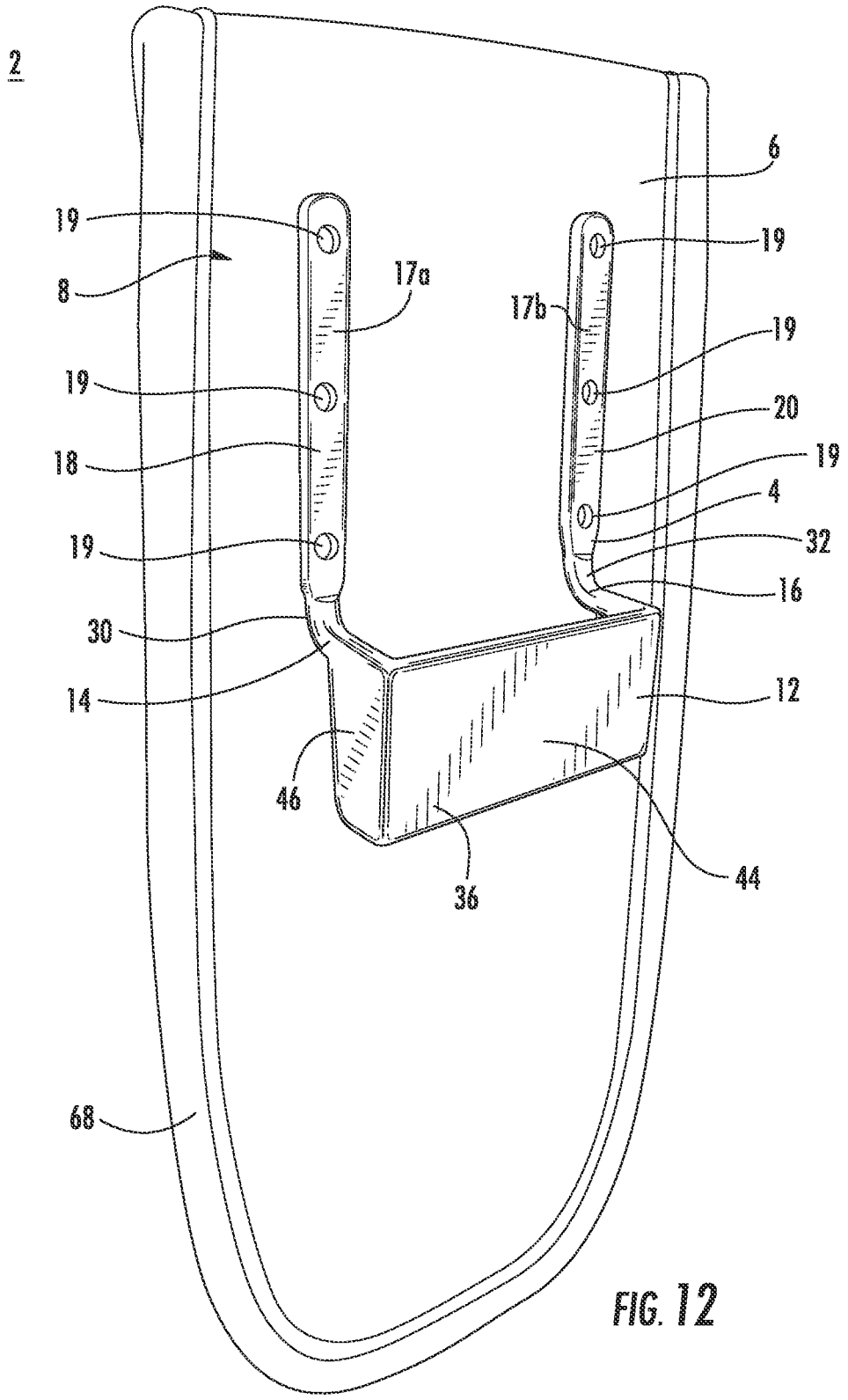
FIG. 12 is a front, perspective view of an embodiment of an air gun holster pouch as described herein, where the support arm strip is coupled to the first leg by a first projection and to the second leg by a second projection.

In some embodiments, as shown in FIG. 12, the first support arm 40 is a first projection extending generally perpendicular from the first leg 18, the second support arm 42 is a second projection extending generally perpendicular from the second leg 20, and a transverse member 44 extends from a distal end of the first projection 40 to a distal end of the second projection 42. The portion of the transverse member 44 extending from the first projection 40 to the second projection 42 can be perpendicular to both the first projection 40 and the second projection 42. As shown in FIGS. 13 & 14, in some embodiments, the transverse member 44 extends generally parallel to the elongated reinforced backing 8.

In some embodiments, the length ($L_{proj}$) of the first projection 40 and the second projection 42 can, independently, be between 0.25 inches and 2.5 inches. In some embodiments, the length ($L_{proj}$) of the first projection 40 and the second projection 42 can, independently, be at least 0.25 inches, at least 0.5 inches, at least 0.75 inches, or at least 1 inch. In some embodiments, the length ($L_{proj}$) of the first projection 40 and the second projection 42 can, independently, be 3 inches or less, 2.5 inches or less, 2 inches or less, 1.75 inches or less, 1.5 inches or less, or 1.125 inches or less, or 1 inch of less.

In some embodiments, as shown in FIGS. 13 & 14, the support arm strip 36 has a uniform support arm strip thickness ($t_{SAS}$), where the support arm strip 36 extends along the first projection 40, the transverse member 44, and the second projection 42, but does not extend the entire length of the support arm 12. In some embodiments, the transverse member 44 extends generally perpendicular to the first projection 40 and the second projection 42. In some embodiments, as shown in FIGS. 12 & 13, the first projection 40, the second projection 42, and the transverse member 44 are all formed from a single bar, while the support arm strip 36 extends down from the first projection 40, the second projection 42, and the transverse member 44.

In some embodiments, as shown in FIGS. 13 & 14, the support arm 12 includes a support arm bar 38 extending from a lower end 30 of the front piece 24*a* of the first leg 18 to a lower end 32 of the front piece 24*b* of the second leg 20, where the support arm strip 36 extends down from the support arm bar 38. The support arm bar 38 can be formed of a bar with a uniform cross-section (e.g., circular), which may deviate from a uniform cross-section where the support arm bar is bent.

In some embodiments, as shown in FIGS. 13 & 14, the first projection 40, the second projection 42, and the transverse member 44 are all formed from a single bar, while the support arm strip 36 extends down from the first projection 40, the second projection 42, and the transverse member 44.

In some embodiments, as shown in FIGS. 4 & 5, the first support arm side 40 and the second support arm side 42 can, independently, have a greater height, $h_{side1}$, closer to the legs 18, 20 and a smaller height, $h_{side2}$, closer the support arm strip 36. In some embodiments, the bottom edges 56 of the first support arm side 40 and the second support arm side 42 can, independently, be horizontal and the top edge 74 of the support arm strip 36 can also be horizontal. In some embodiments, the top edges 58 of the first support arm side 40 and the second support arm side 42 can, independently, be angled with respect to the top edge 74 (and/or horizontal) of the support arm strip 36. The angle (θ) between the top edge 74 of the support art strip 36 (or horizontal) and either of the first and second support arm sides 40, 42 can be at least 5°, or at least 10°, or at least 15°, or at least 20°.

In order to appreciate the benefits of the air gun holster pouch 2 described herein, it is important to understand how the device works. Current air guns are sold with plastic hooks that quickly break off. These hooks are generally used in connection with hooks and conventional hammer holder loops or rings.

Figure 9:
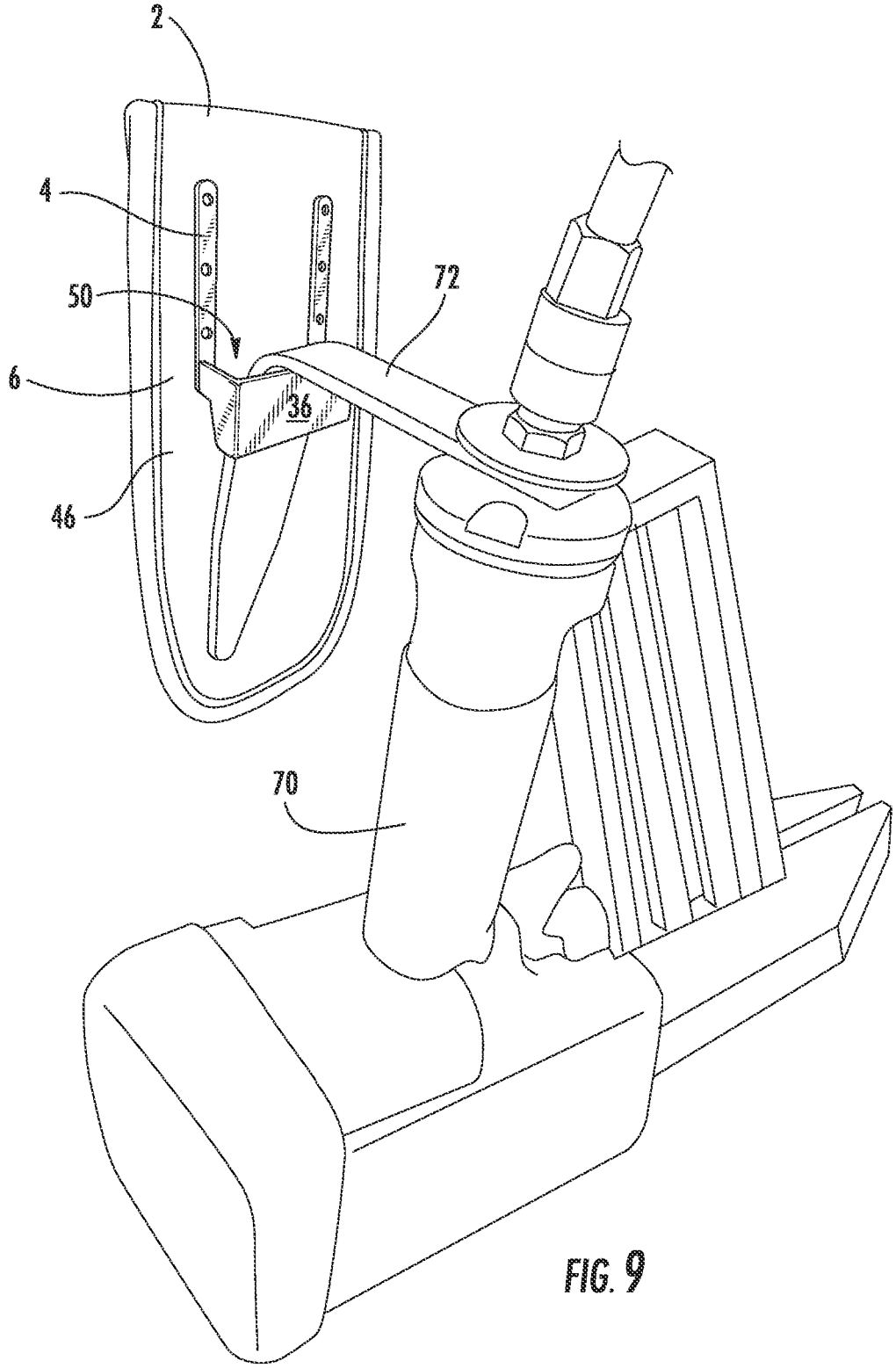
FIG. 9 is an environmental view showing an air gun supported from an air gun holster as disclosed herein.

The air gun holster pouch 2 is designed to be used with an air gun 70 with a bracket 72 (such as an L-shaped bracket) attached to it. The bracket 72 can be attached to a distal end of the handle of the air gun, as shown in FIG. 9. The bracket 72 can include a hole at a first end and, as shown in FIG. 9, an air supply line connector can pass through the hole to secure the bracket 72 to the air gun when the air supply line connector is attached to an air supply line input of the air gun (generally at the distal end of the handle). A free end of the bracket 72 can extend generally parallel to the air gun handle and can be generally tapered In some embodiments, the air gun holster pouch 2 can be sold with such a bracket 72 for attachment to an air gun supply line.

In use, the air gun holster pouch 2 can be secured to a base, such as the user's belt, as shown in FIG. 9. When the user is not using the air gun 70, the user simply slides the free end of the L-shaped bracket 72 into the support arm opening 50. The support arm opening 50 is designed to provide a relatively tight fit for the L-shaped bracket. The flat shape and height ($h_{SAS}$) of the support arm strip 36 are designed to limit the air gun from sliding around when being worn by a worker and prevent accidental releases when the user moves (e.g., bends down to adjust a truss). The length ($L_{proj}$) of the first and second projections 40, 42 and/or support arm sides 46, 48 is also limited to prevent the air gun from sliding around when being worn by a worker. In addition, the distance from the upper edge of the support arm ($d_{SAU}$) to the bottom of the elongated, reinforced backing and the distance from the lower edge of the support arm ($d_{SAL}$) to the bottom of the elongated, reinforced backing ensure that the distal end of the bracket presses against the elongated, reinforced backing, not the worker. Finally, the positioning of the support arm 12 is designed so that, when worn, the air gun 70 will rest against the user's leg above the knee. This allows the worker to control the air gun without using their hands when walking high up on a truss or other elevated structure. In some embodiments, the reinforced backing 6 has a length sufficient to extend to the contact point between the air gun 70 and the user's leg.

Figure 10:
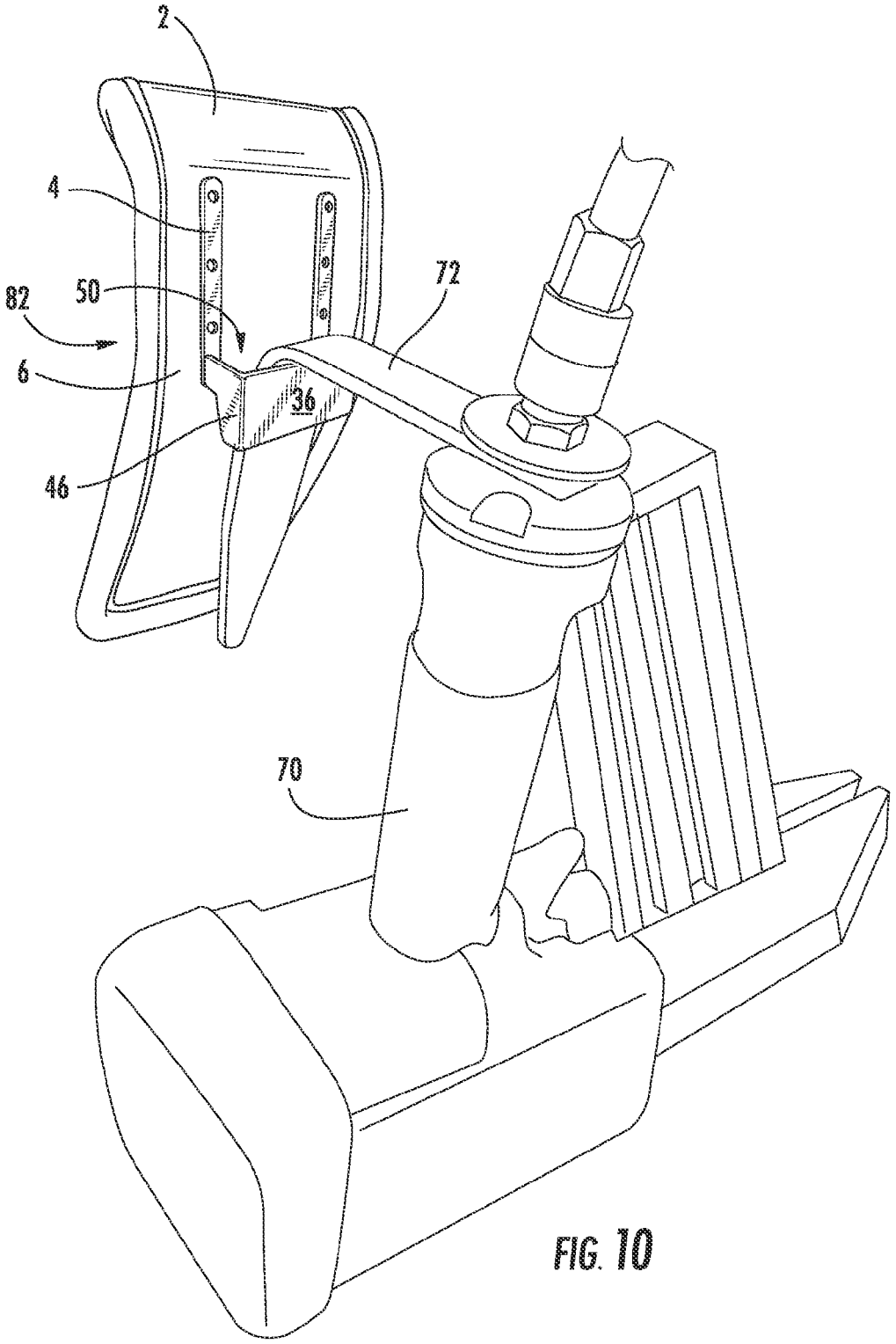
FIG. 10 is an environmental view showing an air gun holster as described herein, where the air gun holster has a bowed shape under the load of an air gun.

In some embodiments, as shown in FIG. 10, the air gun holster pouch 2 is configured to flex or bow when placed under the load of an air gun 70. When the user slides the air gun 70 into the support arm opening 50, the weight of the air gun 70 rests on the support arm 12. The weight of the air gun 70 causes the air gun holster pouch 2 to bow or bend outward, away from the user. In some embodiments, the elongate reinforced backing 6 has a U-shape when under load of the air gun 70. The elongate reinforced backing 6 may bend at any point along its length. In some embodiments, the elongate reinforced backing 6 flexes at the interface between the first resilient material 54 and the second resilient material 56 and the interface between the second resilient material 56 and the fabric material 82. In some embodiments, at least one of the first resilient material 54, the second resilient material 56, and/or the fabric material 82 is a flexible material and flexes under the load of the air gun 70.

The outward flex of the air gun holster pouch 2 provides a channel for air to pass behind the elongate reinforced backing 6. The air movement cools the user. In some embodiments, as shown in FIG. 10, a bottom portion of the elongate reinforced backing 6, such as, for example, the first resilient material 54, contacts the user when the air gun holster pouch 2 flexes away from the user. In some embodiments, the padding, for example, the foam sheet 58 in proximity of the first resilient material 54 extends a significant distance from the reinforcing member 76. The thickness of the foam sheet 58 allows the air gun holster pouch 2 to bow at a greater angle while providing comfort to the wearer.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A mountable tool holster, comprising:

a tool holster, comprising:

a support arm, having a first end spaced apart from a second end, a first leg extending generally perpendicular to said first end, a second leg extending generally perpendicular to said second end; and a reinforced backing, wherein said holster is attached to a front side of the reinforced backing, wherein an intermediate portion of the support arm is generally parallel to the reinforced backing, wherein the tool holster is adapted for an air gun to hang from the support arm via a bracket, wherein said support arm comprises a first projection extending generally perpendicular from the first leg and a second projection extending generally perpendicular from the second leg, and a transverse member extending generally parallel to the elongated, reinforced backing from a distal end of the first projection to a distal end of the second projection, wherein the transverse member extends generally perpendicular to said first projection and said second projection, wherein the transverse member, the first projection, and the second projection comprise a support aim strip, and the support arm strip does not extend the entire length of the support arm, wherein first and second terminal edges of the support arm strip are located at an intermediate portion of the first and second projections, respectively, and wherein said first and second terminal edges are angled.

2. The mountable tool holster according to claim 1, wherein said first leg is coupled to said first end at a lower end of the first leg, and said second leg is coupled to said second end at a lower end of the second leg, wherein the first leg and the second leg are generally parallel.

3. The mountable tool holster according to claim 1, wherein a major axis of said elongated, reinforced backing and a major axis of said tool holster are generally parallel.

4. The mountable tool holster according to claim 1, wherein a maximum gap between said support arm and said elongated, reinforced backing is 2 inches or less.

5. The mountable tool holster according to claim 1, wherein a distance between a bottom edge of said elongated, reinforced backing and an upper edge of said support arm is at least 3 inches.

6. The mountable tool holster according to claim 1, wherein an upper edge of said support arm is above the midpoint of a major axis of the elongated, reinforced backing.

7. The mountable tool holster according to claim 1, wherein a back side of the elongated, reinforced backing comprises a padding system, comprising a first resilient component and a second resilient component, wherein the first resilient component is below the second resilient component.

8. The mountable tool holster according to claim 1, wherein an upper portion of a backside of the elongated, reinforced backing comprises a belt clip, a belt sleeve, or both.

9. The mountable tool holster according to claim 1, wherein said intermediate portion is linear.

10. The mountable tool holster according to claim 1, wherein said tool holster is symmetric along a vertical axis.

11. The mountable tool holster according to claim 1, wherein the support arm strip has a support arm strip height between 0.5 inches and 4 inches.

12. A mountable tool holster, comprising:

a tool holster, comprising:

a support arm, having a first end spaced apart from a second end, a first leg extending generally perpendicular to said first end, a second leg extending generally perpendicular to said second end; and an elongated, reinforced backing, wherein said holster is attached to a front side of the elongated, reinforced backing, wherein an upper edge of said support arm is above the midpoint of a major axis of the elongated, reinforced backing, wherein a back side of the elongated, reinforced backing comprises a padding system, comprising first resilient component with a rubberized outer face, and a second resilient component with a fabric covered outer face, and wherein an upper portion of a backside of the elongated, reinforced backing comprises a belt clip, a belt sleeve, or both.

13. The mountable tool holster according to claim 12, wherein said first leg is coupled to said first end at a lower end of the first leg, and said second leg is coupled to said second end at a lower end of the second leg, wherein the first leg and the second leg are generally parallel.

14. The mountable tool holster according to claim 12, wherein a major axis of said elongated, reinforced backing and a major axis of said tool holster are generally parallel.

15. The mountable tool holster according to claim 12, wherein a maximum gap between said support arm and said elongated, reinforced backing is 2 inches or less.

16. The mountable tool holster according to claim 12, wherein a distance between a bottom edge of said elongated, reinforced backing and an upper edge of said support arm is at least 3 inches.

17. The mountable tool holster according to claim 12, wherein an upper edge of said support arm is above the midpoint of a major axis of the elongated, reinforced backing.

18. The mountable tool holster according to claim 12, wherein a back side of the elongated, reinforced backing comprises a padding system, comprising a first resilient component and a second resilient component, wherein the first resilient component is below the second resilient component.

19. The mountable tool holster according to claim 12, wherein an upper portion of a backside of the elongated, reinforced backing comprises a belt clip, a belt sleeve, or both.

* * * * *